US010519645B2

(12) United States Patent
Meier et al.

(10) Patent No.: US 10,519,645 B2
(45) Date of Patent: Dec. 31, 2019

(54) END WALL FOR A GUTTER FOR SURFACE DRAINAGE

(71) Applicant: ACO SEVERIN AHLMANN GMBH & CO. KOMMANDITGESELLSCHAFT, Budelsdorf (DE)

(72) Inventors: Stephan Meier, Albersdorf (DE); Hans-Julius Ahlmann, Budelsdorf (DE)

(73) Assignee: ACO SEVRIN AHLMANN GMBH & CO KG, Budelsdorf (DE)

( * ) Notice: Subject to any disclaimer, the term of this patent is extended or adjusted under 35 U.S.C. 154(b) by 0 days.

(21) Appl. No.: 16/098,646

(22) PCT Filed: May 2, 2017

(86) PCT No.: PCT/EP2017/060405

§ 371 (c)(1),
(2) Date: Nov. 2, 2018

(87) PCT Pub. No.: WO2017/191127

PCT Pub. Date: Nov. 9, 2017

(65) Prior Publication Data

US 2019/0136501 A1 May 9, 2019

(30) Foreign Application Priority Data

May 4, 2016 (DE) ..... 10 2016 108 354

(51) Int. Cl.
*E03F 3/04* (2006.01)
*E01C 11/22* (2006.01)

(52) U.S. Cl.
CPC ..... *E03F 3/046* (2013.01); *E01C 11/227* (2013.01)

(58) Field of Classification Search
CPC ..... E03F 3/046; E03F 5/0401; E03F 3/04; E01C 11/227
See application file for complete search history.

(56) References Cited

U.S. PATENT DOCUMENTS

| | | | |
|---|---|---|---|
| 2,701,027 | A | 2/1955 | Scoville |
| 6,027,283 | A | 2/2000 | Schweinberg et al. |
| 6,540,437 | B1 | 4/2003 | Larson |

FOREIGN PATENT DOCUMENTS

| | | | |
|---|---|---|---|
| DE | 3519108 | A1 | 12/1986 |
| DE | 102006053345 | A1 | 5/2008 |

(Continued)

OTHER PUBLICATIONS

ACO XtraDrain X 100 Kombistirnwand / Stimwand mit Stutzen DN/OD 110 Published on the ACO website as a technical description.

(Continued)

*Primary Examiner* — Carib A Oquendo
(74) *Attorney, Agent, or Firm* — Pearne & Gordon LLP

(57) ABSTRACT

In order to seal gutters at the ends with low output, an end wall (10) of a gutter (30) is provided for surface drainage, comprising a plate element (11) which can be secured at a first or a second end of the gutter (30) substantially sealingly closing a cross-section of the gutter (30). In addition, the ends (31, 32) of the gutter (30) are formed differently. According to the invention, in order to reduce the output, the plate element (11) can be secured at the first end (31) of the gutter (30) with a first edge (12) oriented upwards or can be secured at the second end (32) with a second edge (13) oriented upwards. In this way, an adjustment can be made to both differently formed ends (31, 32) of the gutter (30) by simply rotating the plate element.

9 Claims, 6 Drawing Sheets

(56) References Cited

FOREIGN PATENT DOCUMENTS

| | | | | |
|---|---|---|---|---|
| DE | 102005012146 | | * | 5/2010 |
| EP | 0542701 | A1 | | 5/1993 |
| EP | 1479838 | A2 | | 11/2004 |

OTHER PUBLICATIONS

Galabau—Das Programm für den Garten- und Landschaftsbau, Ausgabe 2.5 Published on the Hauraton website as brochure.
Allgemeine bauaufsichtliche Zulassung, Nr. Z-74.4-78 Published on the internet, available as download or print version via the homepage of DIBt.
Technical description „T1 Published on the ACO website or as print version available via ACO.
The search report issued in corresponding German Application No. 10 2016 108 354.2; dated Jan. 31, 2017.

* cited by examiner 20
13
21
25
22
14
1
21
13
20
24
14
23
14'
23

37
32
33
31
36

END WALL FOR A GUTTER FOR SURFACE DRAINAGE

The invention relates to a headboard of a gutter for surface drainage according to the preamble of claim 1.

Drainageways are often installed as very long gutter systems, wherein the ends of these gutter systems have to be closed. For closing such a gutter system, gutters are known, for example, from EP 0 542 701 B1 or DE 35 19 108 A1, whose ends have pockets or receiving arrangements, into which cutoff walls can be inserted. Such arrangements are complicated.

Gutters, which can be provided with headboards, which are held on the gutter by means of a force fit, are known from U.S. Pat. No. 2,701,027 or 6,540,437 B1. Such fasteners are both complex and unreliable. In addition, there is a problem because gutters have different ends, like a groove and a tongue end. Such different ends are used to attach the gutters tightly to each other. Depending on which end is to be closed, different headboards must be available.

From EP 1 479 838 B1 a headboard according to the preamble of claim 1 is known, wherein the manner in which the snapping elements are to be formed is not apparent from the document. Moreover, the above-mentioned problem of closing the different ends of the gutters is not solved.

The invention addresses the problem of forming a headboard of the type mentioned in that in a simple way different gutter ends can be closed using one and the same component.

This object is achieved by a headboard according to claim 1.

In particular, this problem is solved by means of a headboard of a gutter for surface drainage, comprising a plate element, which can be fastened to a first or a second end of the gutter thereby substantially closing a cross-section of the gutter, wherein the ends are formed differently, where the plate element can be either attached to the first end with a first edge pointing upwards or to the second end of the gutter with a second edge pointing upwards.

Because the headboard has two different cross-sectional designs, depending on whether the first edge or the second edge protrudes upwards, the design can be adapted to the various adaptation needs or the different cross-sections of the gutter. Both surfaces of the headboard thus always remain either an outward facing surface, which, in the installed state, is in contact with the soil, or an inner surface, which faces the interior of the gutter.

The two edges could then be e.g. at right angles to each other. If however, only two different gutter ends have to be accommodated, it is preferred that the first edge is on the opposite side of the second edge. This results in a simple structure.

The plate element preferably has snap-in hooks or similar fasteners, which can be brought into retaining engagement with correspondingly formed counter-elements on the gutter. This makes for a very simple installation.

These fasteners are preferably attached to vertical edges of the plate element. This results in a further simplification of the assembly on site.

Preferably, the fasteners are mounted in pairs at equal distances from the first and the second edge. The symmetrical construction results in a secure retention.

The plate element preferably comprises an elastic sealing layer, whose contour is adapted to the first and the second end of the gutter. Such a sealing layer is very simple to produce.

The first and/or the second edge of the plate element preferably comprises an impact protection, improving the durability of the overall arrangement. This impact protection is then designed to terminate in a plane with the surface of the commonly provided gutter cover.

The reinforcement is preferably formed as a metal sheet, improving its durability.

Preferably, an additional plate element is provided, which is designed such that it can be fastened to the first or second end of the gutter on the one hand and then the remaining free surface can be pressed in a sealing manner onto a side surface of a gutter to form a T-piece. In this case, no end plate but, so to speak, a coupling plate is formed.

The invention is thus also defined by a gutter kit comprising at least one gutter and two headboards, as described above.

Below, exemplary embodiments of the invention will be explained in more detail with reference to figures.

In the figures

In the following description, the same reference numerals are used for identical and identically acting parts.

Figure 1:
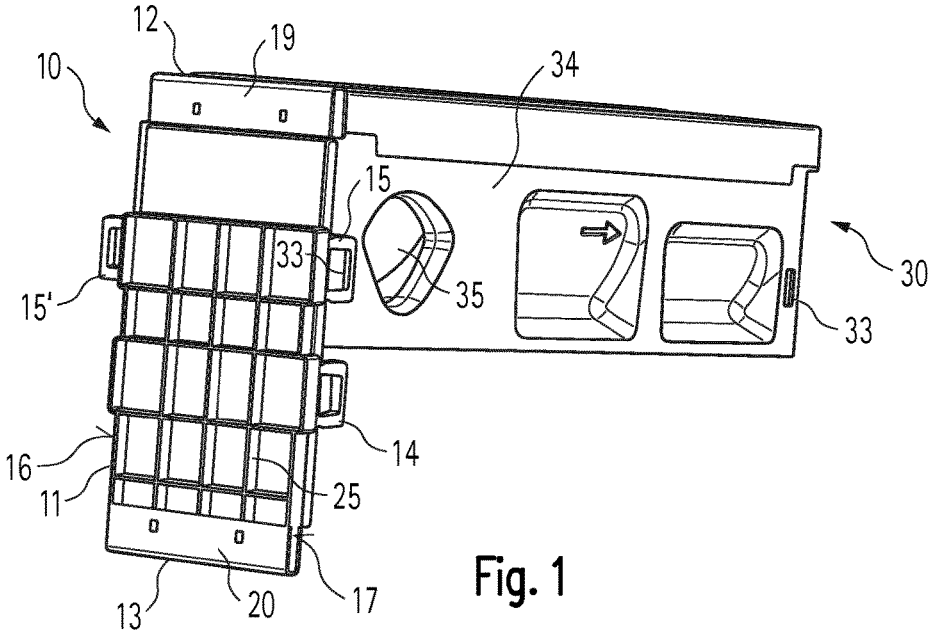
FIG. 1 shows an embodiment of the invention with mounted headboard.
Figure 2:
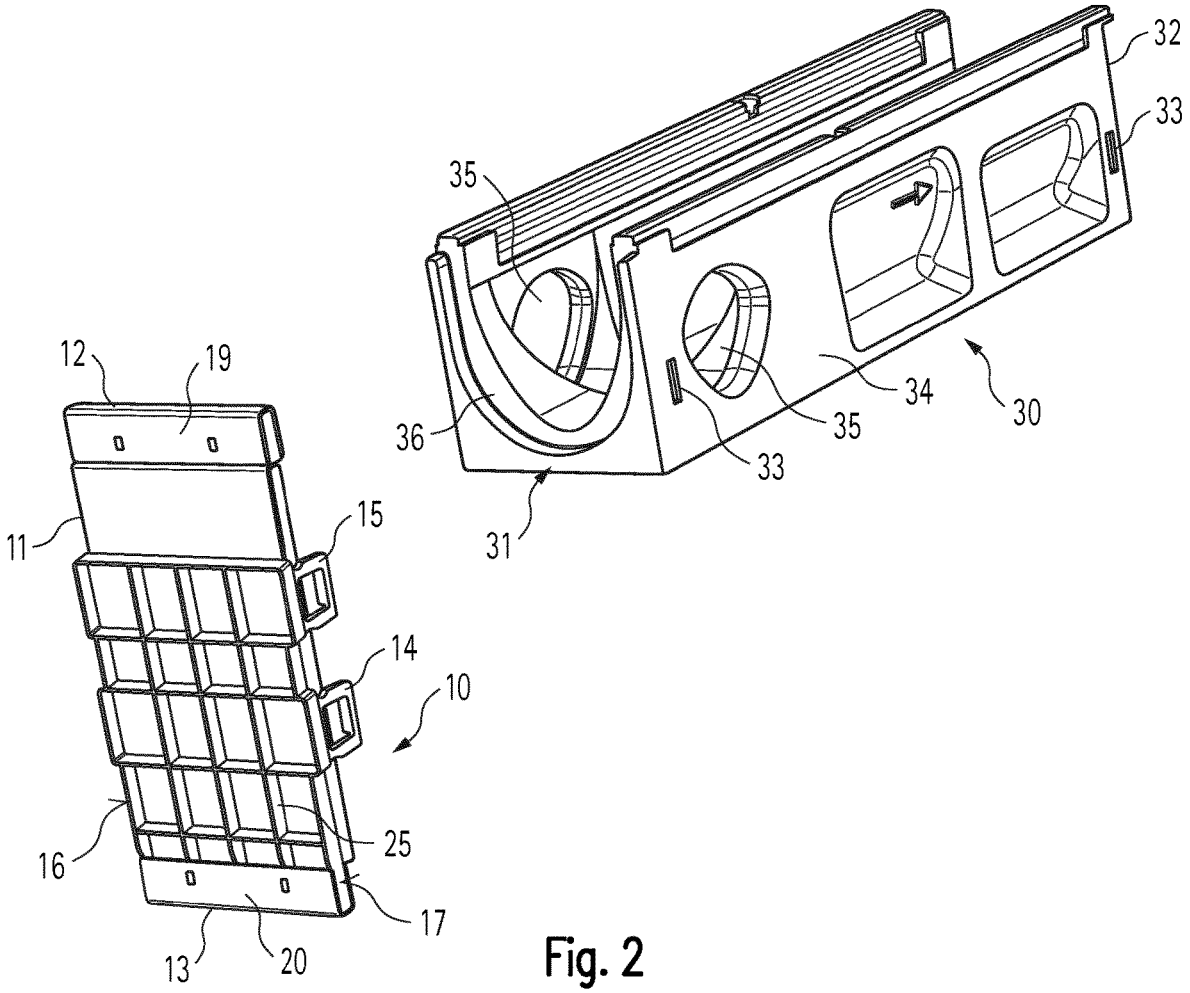
FIG. 2 shows a perspective view of the arrangement of FIG. 1 but with removed headboard and without frames.

The arrangement shown in FIGS. 1 and 2 comprises a gutter 30 having a first end 31 and a second end 32. The first end 31 has a recess 36, which can receive a projection 37, which is provided at the second end 32. Here particular reference is made to FIG. 3.

The gutter 30 has openings 35 on side surfaces 34, to which further gutters can be connected, as will be described below with reference to FIGS. 4-7.

Headboards 10 are provided to close the interior of the gutters 30 at the end of a gutter system. The headboard 10 comprises a plate element 11, which is provided with reinforcing ribs 25 on one surface. Furthermore, 11 snap-in hooks 14, 14' and 15, 15' are provided on the plate element, said snap-in hooks which are fastened to counter-elements 33 of the gutter 30 such that the plate element 11 or a sealing layer 18 of the headboard 10 (see FIG. 3) rests against the first end 31 or the second end 32 of a gutter 30. This sealing layer 18 is thus mounted on a surface of the plate element 11 opposite the reinforcing ribs 25.

The headboard 10 furthermore has a reinforcement 19 on its first edge 12 and a reinforcement 20 on its second edge 13.

Figure 3:
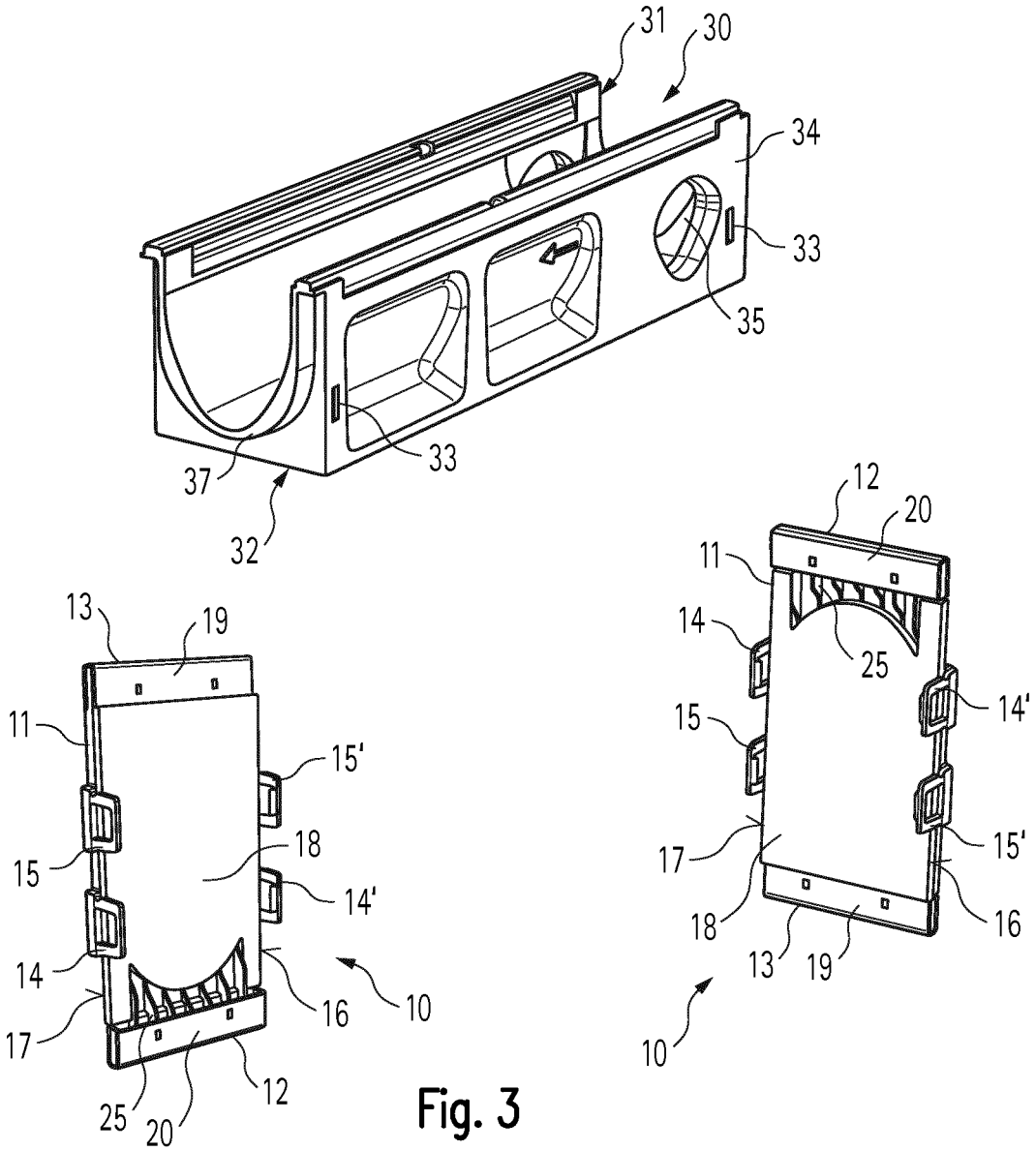
FIG. 3 shows a perspective view of the gutter according to FIGS. 1 and 2 with both headboards, each in the correct orientation for the two different ends of the gutter and again without frames.
Figures 4, 5, 6:
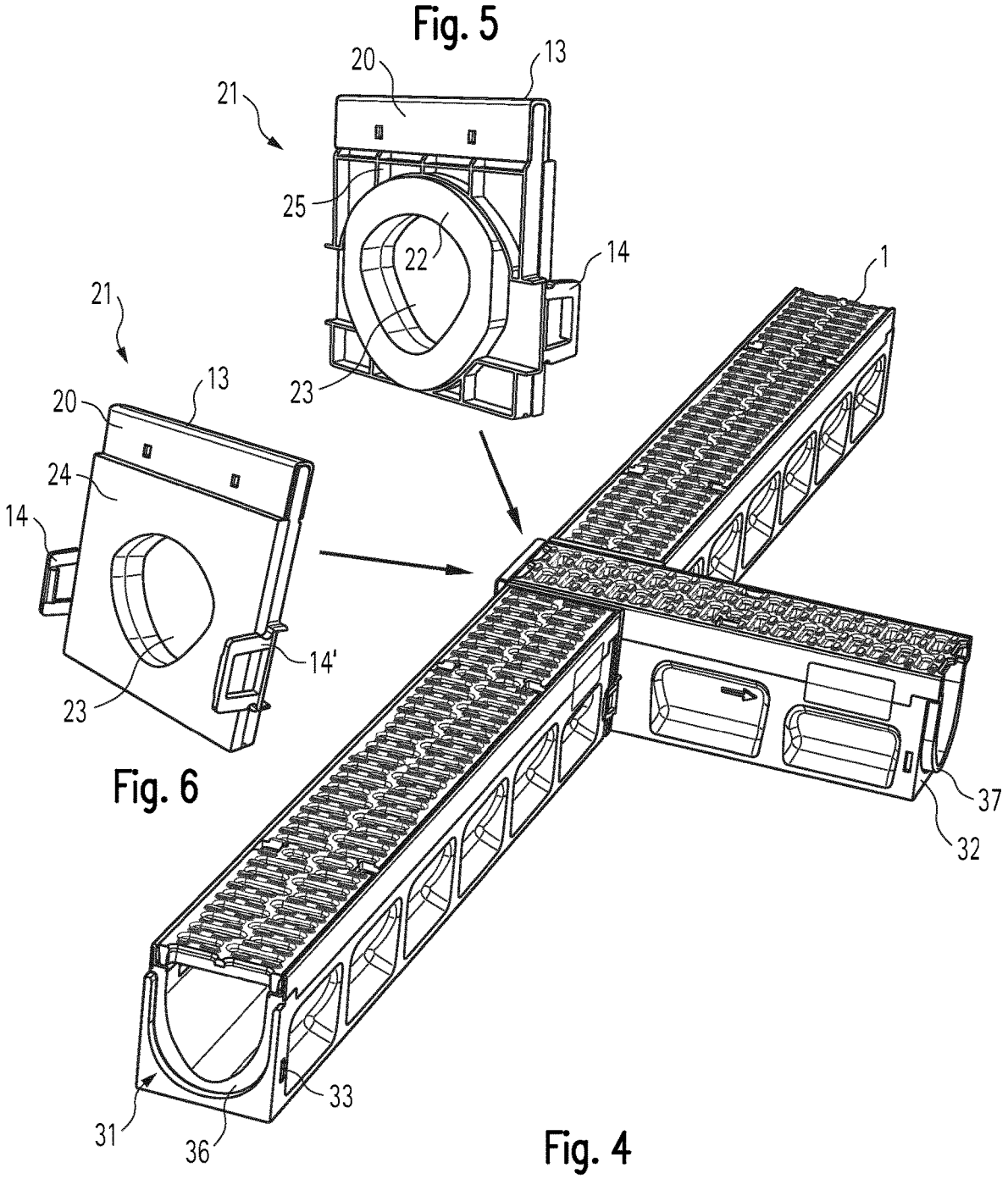
FIGS. 4-6 show a perspective view of a T-gutter arrangement with representations of additional plate elements to form the arrangement.
Figure 7:
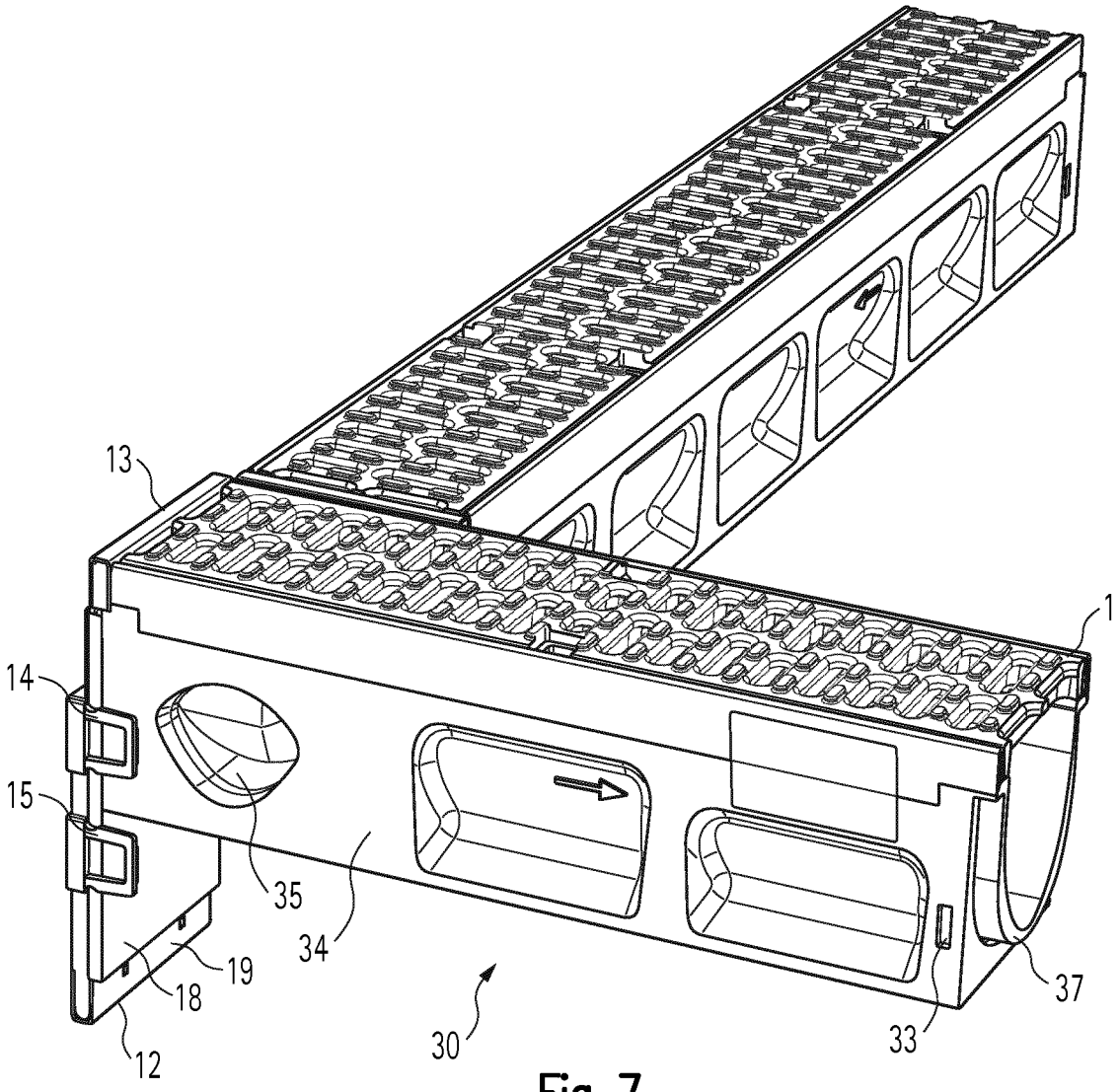
FIG. 7 shows the arrangement according to FIG. 4 but without the end piece of the gutter.

The contour of the sealing layer 18 is adapted to the semi-circular shape of the projection 37 of the gutter 30 at its side facing the second edge 12 (see FIG. 3 on the left). By contrast, the contour of the sealing layer 18 on its side facing the first edge 13 is shaped corresponding to the contour of the first end 31 of the gutter 30, as illustrated in FIGS. 2 and 3 (right).

Furthermore, the reinforcements 19 and 20 are mounted and formed on the plate element 11 (see in particular FIGS. 8-10) such that these reinforcements closely abut any frames and covers 1, which cover the top of the gutter 30 (see FIGS. 4-7). Due to this construction, one and the same headboard can be used to close both ends 31 and 32 of one gutter 30.

Figure 8:
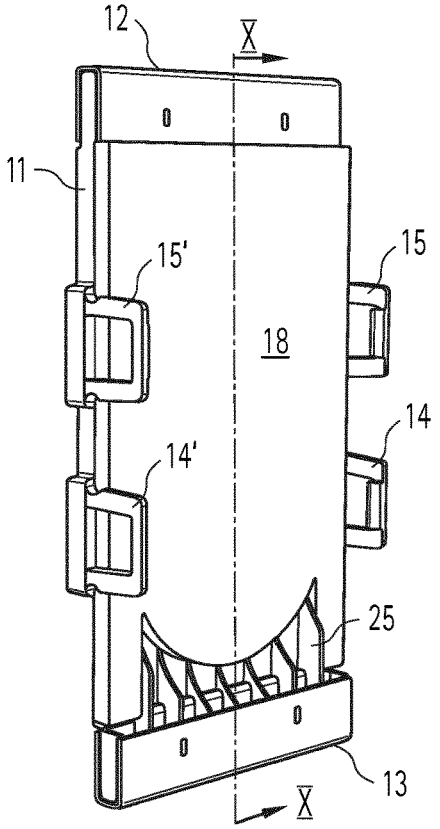
FIG. 8 shows a perspective view of a headboard, similar to that of FIGS. 1-3.
Figure 9:
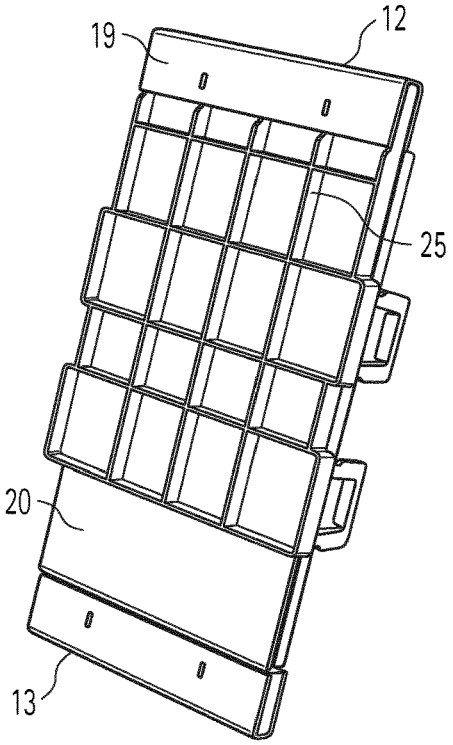
FIG. 9 shows the headboard according to FIG. 8 from the other (outer) side.
Figure 10:
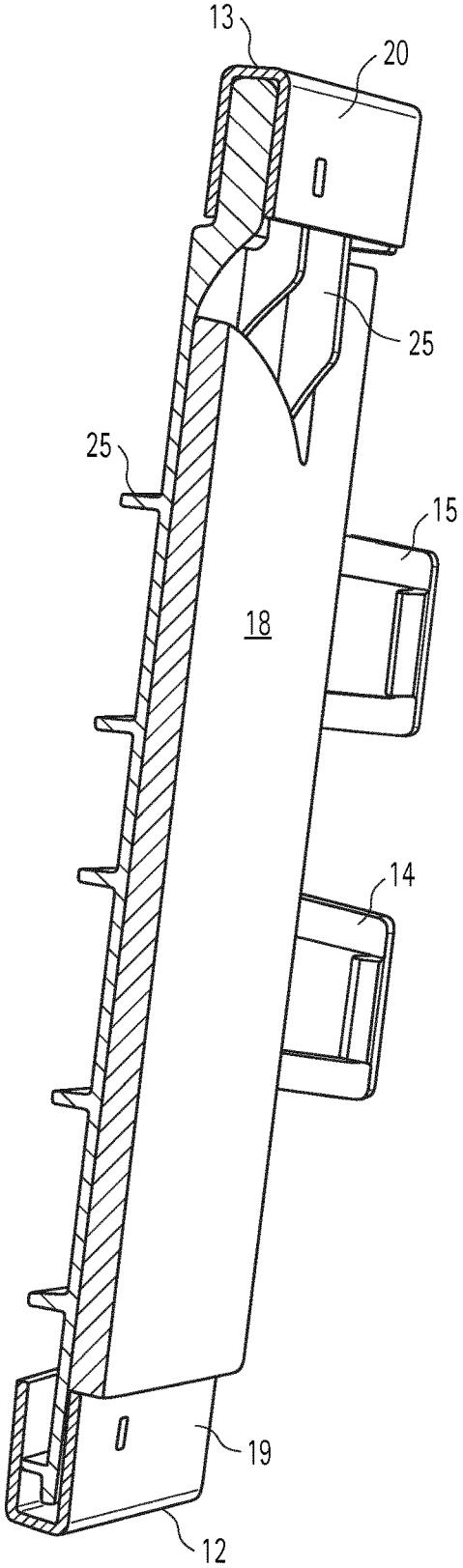
FIG. 10 shows a cross-section through the arrangement according to FIG. 8 along the line X-X.
Figure 11:
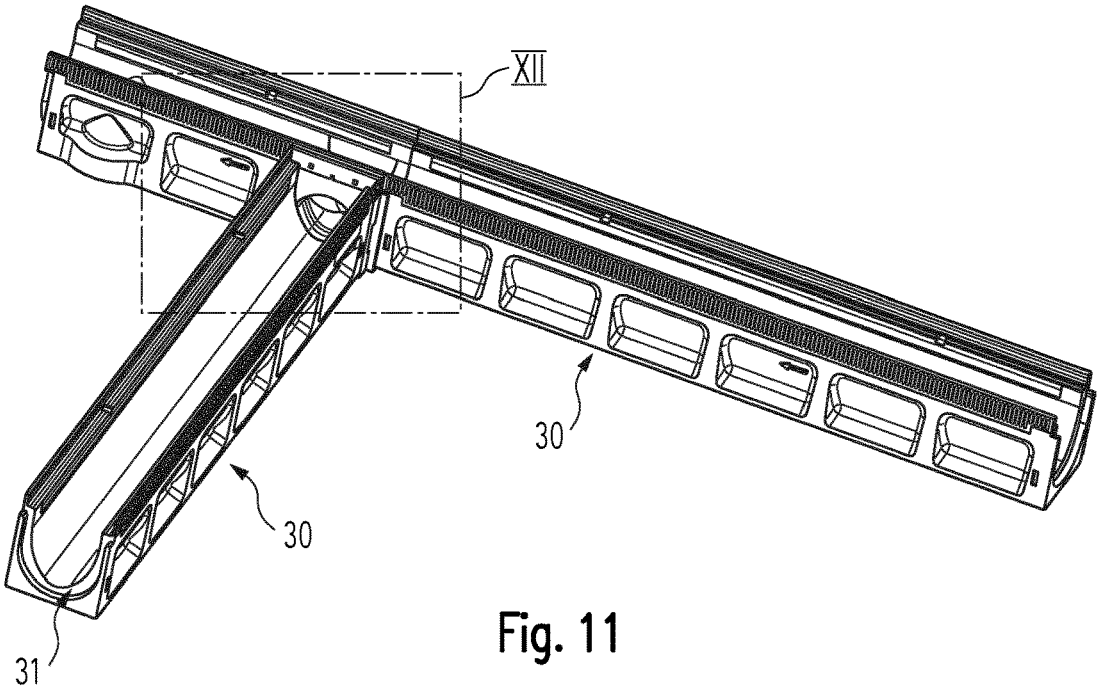
FIG. 11 shows a further illustration of a corner and/or T-connection including the coupling plate but without the headboard.
Figure 12:
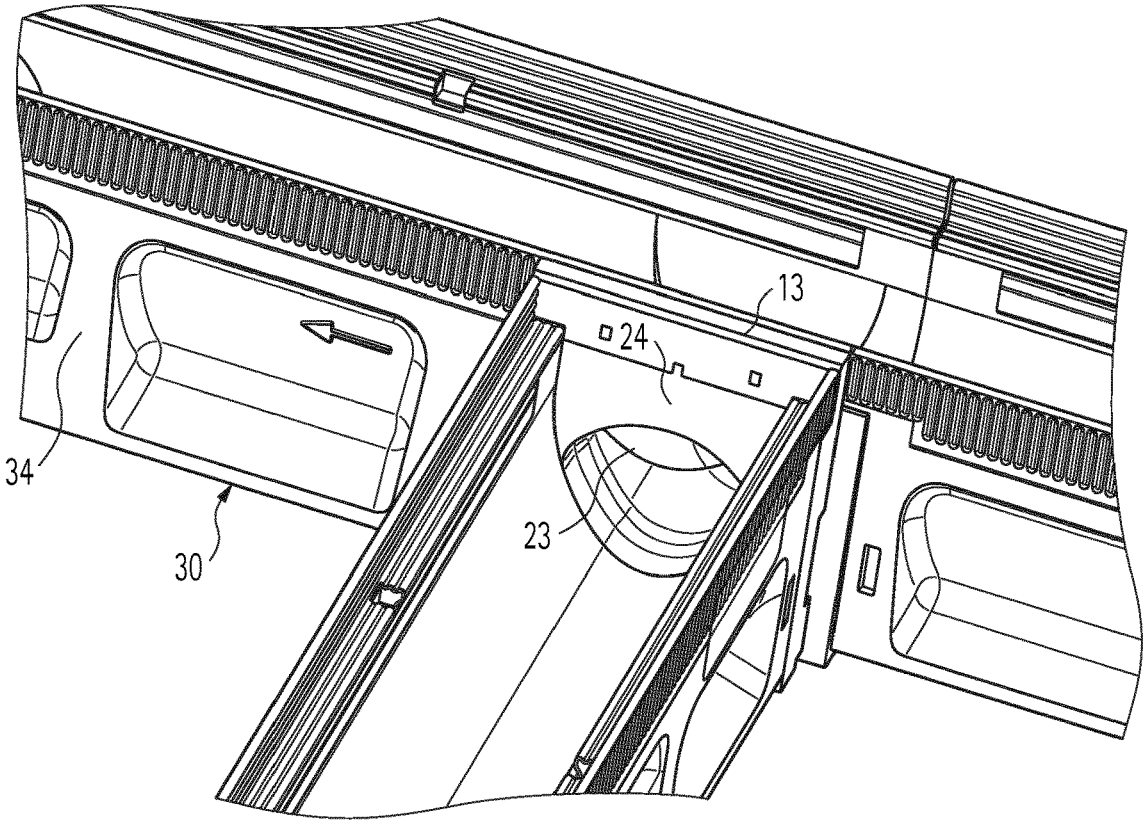
FIG. 12 shows an enlargement of section XII of FIG. 11.

The stability, in particular the bending strength of the plate element 11, is—as is apparent in particular in FIGS. 8-10—achieved by reinforcing ribs 25, wherein the impact resistance of the two edges 12 and 13 is achieved by the reinforcements 19, 20 made of sheet steel.

Subsequently, reference is made to FIGS. 4-7, 11 and 12 to describe an "additional" plate element 21, which serves to connect the end face of a gutter 30 to an opening 35 in a side surface 34 of another gutter 30. This additional plate element 21 now has a reinforcement 20 on a single edge 13 and can have a single pair of snap-in hooks 14, 14', as this additional plate element 21 is always attached in the same orientation to a gutter 30. Depending on the height of the gutter 30, the plate element 21 can have additional snap-in hooks, however. In contrast to the first plate element 11, however, the additional plate element 21 has sealing devices on both surfaces. On one surface, a sealing surface 24 is provided, which is completely flat and rests on a first end 31 or a second end 32 of a gutter 30 if the snap-in hooks 14, 14' of the additional plate element 21 are attached to the corresponding counter-elements 33 of a gutter 30. A sealing bead 22 enclosing an opening 23 is provided opposite the sealing surface 24, which sealing bead is designed such that it can be placed sealingly around the opening 35 on a side face 34 of a gutter 30. This arrangement can then be used to establish either right-angled branches or T-joints, as shown in FIGS. 5-7, 10 and 11.

From the above it is apparent that it is regarded as essential to the invention to form a (single) headboard for adaptation to two different gutter ends such that it is adapted to exactly these two different ends of the gutter depending on the orientation by a first edge pointing upwards or downwards. This also applies to appropriately formed snap-in hooks, which can be used to attach the headboard to the gutter.

LIST OF THE REFERENCE NUMERALS

1 cover
10 headboard
11 plate element
12 second edge
13 first edge
14, 14' first snap-in hook
15, 15' second snap-in hook
16 vertical edge
17 vertical edge
18 sealing layer
19 reinforcement
20 reinforcement
21 additional plate element
22 sealing bead
23 opening
24 sealing surface
25 reinforcing rib
30 gutter
31 first end
32 second end
33 counter element
34 side surface
35 opening
36 recess
37 projection

The invention claimed is:

1. A headboard (10) of a surface drainage gutter (30) comprising:

a. a plate element (11) having a cross-section of the gutter (30), the plate element (11) comprising a first face and a second face defined by two vertical edges (16, 17) opposite one another, and a first edge (12) arranged opposite a second edge (13), the vertical edges (16, 17) each comprising a pair of mounted fastening devices (14, 14', 15, 15'), b. the gutter (30) comprises counter-elements (33) for engagement with the fastening devices (14, 14', 15, 15') of the plate element (11), a first end (31) and a second end (32) formed differently from one another, wherein the plate element (11) can be sealably fastened to both the first end (31) and the second end (32) of the gutter (30), and wherein when the plate element (11) is fastened in a sealing manner to the first end (31) of the gutter (30), the first edge (12) points upwards and when the plate element (11) is fastened in a sealing manner to the second end (32) of the gutter (30), the second edge (13) points upwards.

2. The headboard according to claim 1, wherein the pair of mounted fastening devices (14, 14', 15, 15') on the vertical edges (16, 17) are spaced at equal distanced along the length of the vertical edges (16, 17) and away from the first edge (12) and the second edge (13).

3. The headboard according to claim 1, wherein the fastening devices (14, 14'; 15, 15') are snap-in hooks that engage the counter-elements (33) of the gutter (30).

4. The headboard according to claim 1, wherein the plate element (11) comprises an elastic sealing layer (18) with a contour that is adapted to the first end (31) and the second end (32) of the gutter (30).

5. The headboard according to claim 1, wherein the first edge (12) and the second edge (13) of the plate element (11) comprise a reinforcement (19, 20).

6. The headboard according to claim 5, wherein the reinforcement (19, 20) is made of sheet metal.

7. The headboard according to claim 1, wherein an additional plate element (21) is fastened to the first end (31) or the second end (32) of the gutter (30) and pressed in a sealing manner onto a side surface (34) of another gutter to form a T-piece.

8. A gutter kit, comprising at least one gutter (30) and two headboards (10) according to claim 1.

9. The headboard according to claim 1, wherein the first face comprises a reinforcing rib (25) adjacent a metal reinforcement (20) on the first edge (12).

* * * * *